US005630586A

United States Patent [19]

Lowden

[11] Patent Number: 5,630,586

[45] Date of Patent: May 20, 1997

[54] COMBINED SLOT MACHINE AND TABLE GAME APPARATUS AND METHOD OF PLAY

[76] Inventor: David Lowden, 3221 S. Torrey Pines, Las Vegas, Nev. 89102

[21] Appl. No.: 633,067

[22] Filed: Apr. 16, 1996

[51] Int. Cl.[6] ..... G07F 17/34; A47B 25/00

[52] U.S. Cl. ..... 273/138.2; 273/143 R; 273/309; 273/274; 463/20

[58] Field of Search ..... 273/138.2, 143 R, 273/309, 274; 463/20, 12, 13, 22, 32, 34, 46

[56] References Cited

U.S. PATENT DOCUMENTS

| | | | |
|---|---|---|---|
| 4,614,342 | 9/1986 | Takashima | 463/46 |
| 4,861,041 | 8/1989 | Jones et al. | 273/292 |
| 4,995,615 | 2/1991 | Cheng | 273/292 |
| 5,078,405 | 1/1992 | Jones et al. | 273/309 |
| 5,221,083 | 6/1993 | Dote | 463/32 |
| 5,240,249 | 8/1993 | Czarnecki et al. | 273/237 |
| 5,259,613 | 11/1993 | Marnell, II | 463/42 |
| 5,263,715 | 11/1993 | Matsumoto et al. | 463/22 |
| 5,356,140 | 10/1994 | Dabrowski et al. | 463/12 |
| 5,377,973 | 1/1995 | Jones et al. | 273/292 |
| 5,382,025 | 1/1995 | Sklansky et al. | 273/292 |
| 5,472,194 | 12/1995 | Breeding et al. | 463/27 |

FOREIGN PATENT DOCUMENTS 2117546 10/1983 United Kingdom ..... 273/143 R

*Primary Examiner*—Benjamin H. Layno
*Attorney, Agent, or Firm*—Quirk & Tratos

[57] ABSTRACT

A casino table game played by a dealer and one or more players seated at player stations at a table. After a player places an ante wager, the dealer depresses a dealer spin button on a control panel to cause one of a plurality of indicium on respective arc segments of each of two dealer reels of a slot machine to randomly appear on a payline of the machine. Thereafter, the player may place a combination bet on a prospective appearance of any of a plurality of combinations of indicia on the payline. Additionally, the player may make a proposition bet on a prospective appearance of a predetermined combination of indicia on the payline. After the dealer operates a player enable button on the control panel, the player operates a player spin button at the player's player station to cause one of a plurality of indicium on respective arc segments of the player reel to randomly appear on the payline. Thereafter, the ante wager, the combination bet and the proposition bet are reconciled, with the player winning when there is a winning combination of indicia on the payline; otherwise, the player loses.

14 Claims, 2 Drawing Sheets

COMBINED SLOT MACHINE AND TABLE GAME APPARATUS AND METHOD OF PLAY

FIELD OF THE INVENTION

This invention is in the general field of casino gaming and, more particularly, is a game where a player makes a wager on a prospective appearance of indicia on a payline of a slot machine after a spinning of a reel of the machine.

DESCRIPTION OF THE PRIOR ART

There is almost a mystical appeal of a slot machine to a large portion of the people who enjoy games of chance. An electronic slot machine is a recent innovation that has improved slot machine performance. However, most patrons who engage in slot machine play at a casino prefer an electromechanical slot machine with reels and a lever, often referred to in the vernacular as a one armed bandit.

Slot machine play is important to the casino because it accounts for a substantial share of the profit in gaming at the casino. The remainder of the profit is accounted for by table games such as Blackjack and Roulette.

A feature of the slot machine is that odds and payouts associated therewith are predictable. Moreover, the odds and payouts can be tailored to the preferences of a manager of the casino. Because of the importance of slot machine play, the casino manager constantly searches for a marketing strategy to widen its appeal.

One marketing strategy is to have a new game which includes aspects of both table game play and slot machine play, thereby attracting the slot machine player and the table game player. Attracting the slot machine player to the new game may result in the slot machine player playing table games. Correspondingly, attracting the table game player to the new game may result in the table game player playing slot machines. Heretofore, there has not been a slot machine game which is suitable for inclusion in the strategy.

SUMMARY OF THE INVENTION

An object of the present invention is to widen the appeal of slot machine play at a casino.

Another object of the present invention is to encourage a slot machine player to play a table game.

In one specific embodiment of the present invention, after a player makes an ante wager, a dealer operates a dealer spin button to cause a dealer reel of a slot machine to briefly spin, whereby one of a plurality of indicium on respective arc segments of the dealer reel randomly appears on a payline of the machine. Thereafter, the player has an option of making a combination bet related to a prospective appearance of indicia on the payline. The player operates a player spin button to cause a player reel of the machine to briefly spin, whereby one of a plurality of indicium on respective arc segments of the player reel randomly appears on the payline.

In another specific embodiment of the present invention, a player makes a proposition bet related to a prospective appearance of an indicium on a payline of a slot machine and then operates a player spin button. In response to the operation of the player spin button, a reel of the machine briefly spins, thereby causing one of a plurality of indicium on arc segments of the reel to randomly appear on the payline.

The present invention is a slot machine table game that includes some aspects of a table game and, therefore, has an attraction to a table game player who would not otherwise participate in a slot machine game. Correspondingly, the slot machine table game includes some aspects of a slot machine game and, therefore, has an attraction to a slot machine player who would not otherwise participate in a table game.

Other objects, features, and advantages of the invention should be apparent from the following description of embodiments thereof as illustrated in the accompanying drawing.

DESCRIPTION OF THE EMBODIMENTS

Figure 1:
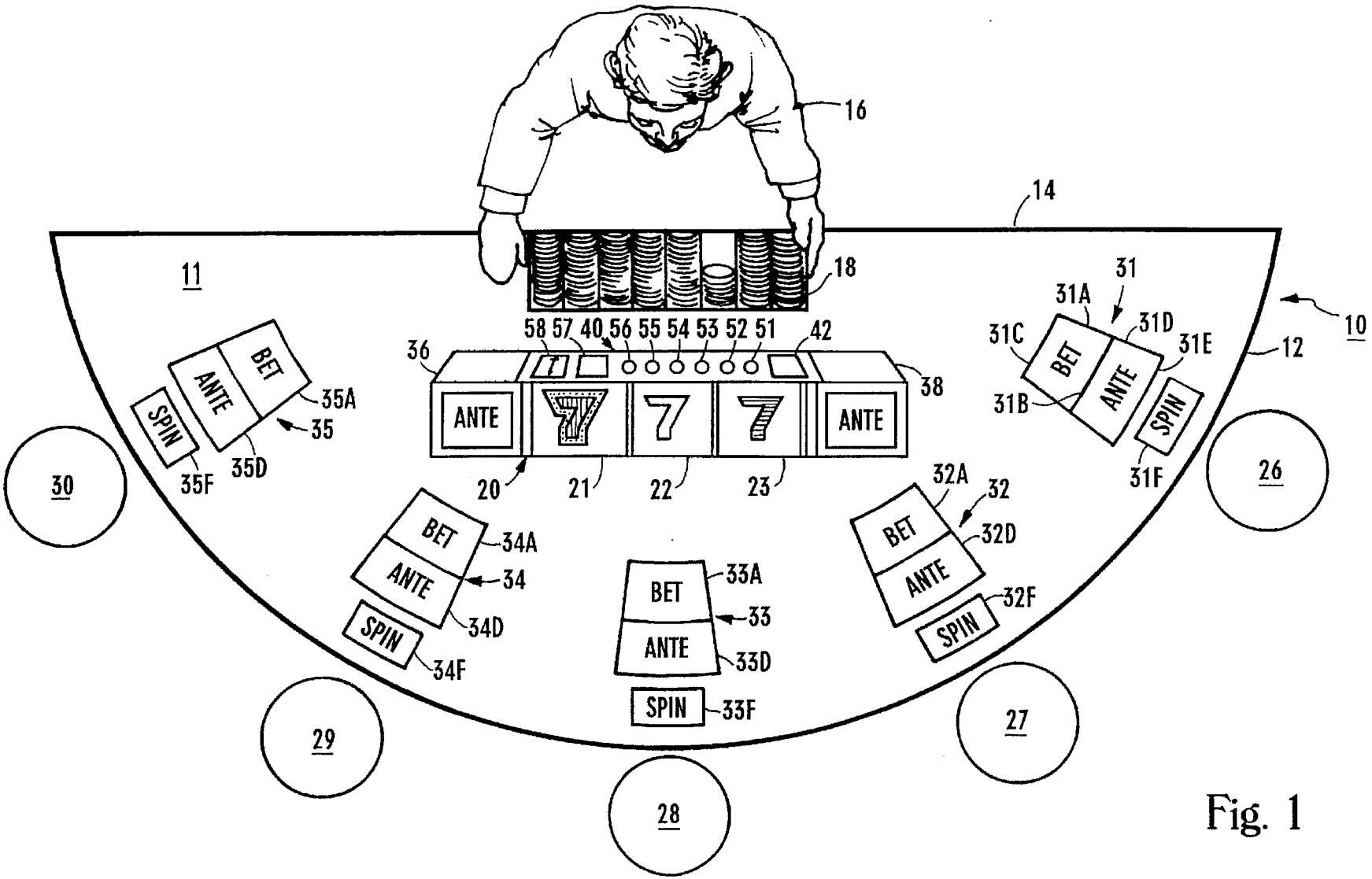
FIG. 1 is a plan view of a dealer at a table where a game is played in accordance with a first embodiment of the present invention.
Figure 2:
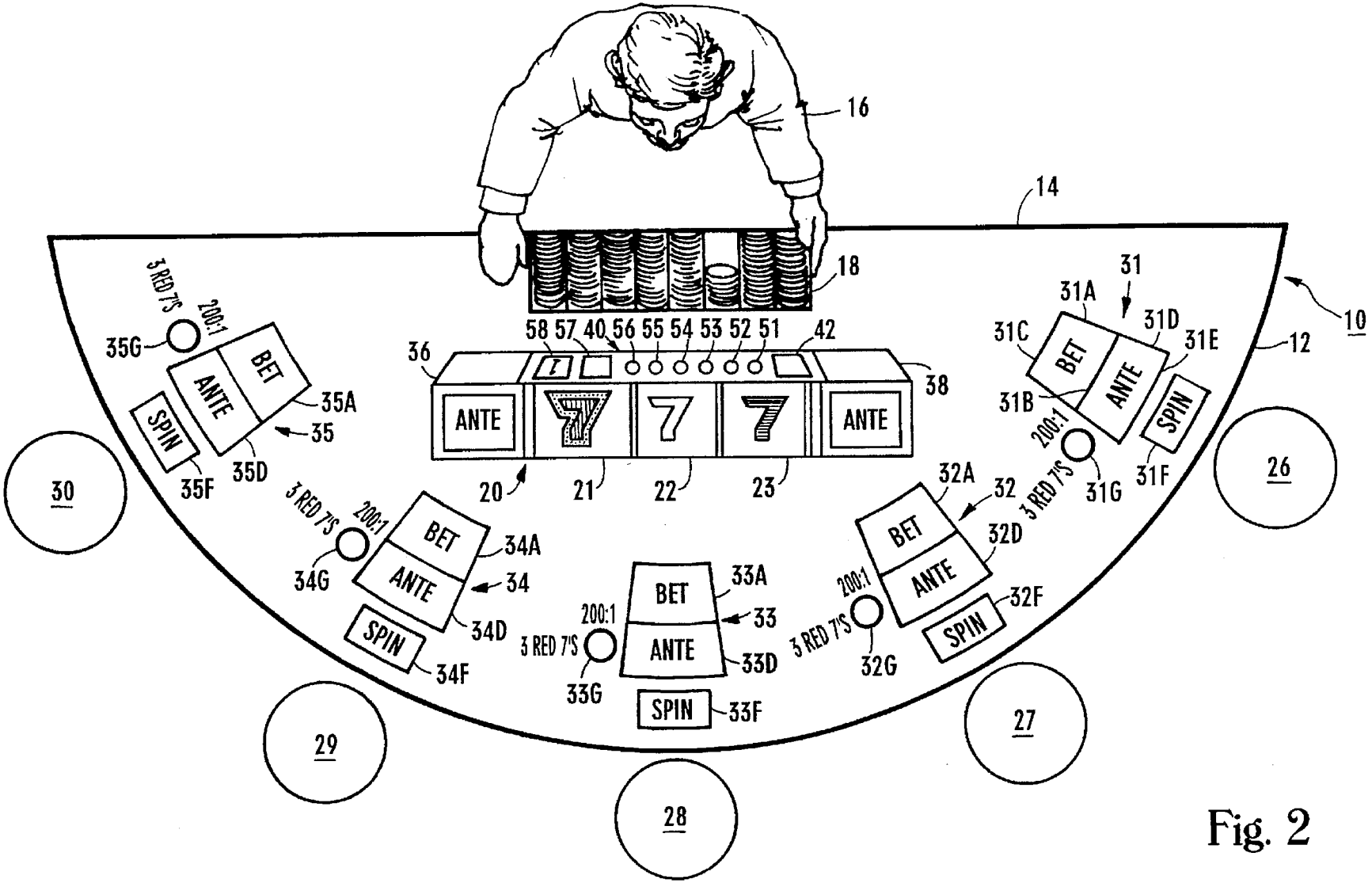
FIG. 2 is a plan view of a dealer at a table where a game is played in accordance with a second embodiment of the present invention.

As shown in FIG. 1, in a first embodiment of the present invention, a table at a casino has a semicircular top 10 that includes an arcuate edge 12 and a straight edge 14. The top 10 has a covering 11 that is preferably made from colored felt but may alternatively be made from any other suitable material.

A dealer 16 is positioned near the center of the edge 14 adjacent to a cheque rack 18 where wagering tokens of the casino (known as chips or cheques) are stored. A slot machine 20 that is connected to the covering 11 is within reach of the dealer 16.

Arc segments 21–23 of first and second dealer reels and a player reel of the machine 20, respectively, comprise what is known as a payline. It should be understood that the payline is randomly changed in response to a brief spinning of a reel.

In an exemplary game, the reels are each comprised of six arc segments of equal length that carry thereon an indicium in the form of lettering of either a Red 7, a White 7 or a Blue 7. The arc segments 22, 23 are exemplary of segments that respectively carry a White and a Red lettering of 7's. As explained hereinafter, a player receives a payout from the dealer 16 when the payline comprises a winning combination of the sevens.

Some of the lettering of the sevens are outlined with a gold color. The sevens with the gold colored outline are used by a manager of the casino as a control over the amount of money that the casino returns to the player. More specifically, the sevens with the gold colored outline create a winning combination from what otherwise would be a losing combination. The arc segment 21, for example, carries a blue lettering of a seven with a gold colored outline. The playing of the exemplary game and the winning combinations are described hereinafter.

The number of each of the sevens carried on the arc segments of a reel is in accordance with frequencies of table I which are given as:

TABLE I

| | |
|---|---|
| Red 7's | 1 of 6 arc segments |
| White 7's | 2 of 6 arc segments |
| Blue 7's | 3 of 6 arc segments |

In an alternative embodiment, the reels have more than six arc segments. However, on any of the reels, one sixth of the sevens are red, one third of the sevens are white and one half of the segments are blue, whereby the frequencies of table I are preserved.

The arc segments with the gold colored outlines are in accordance with table II which is given as:

TABLE II

| REEL | ARC SEGMENTS THAT CARRY GOLD COLORED OUTLINE |
|---|---|
| First Dealer Reel | three Blue 7's |
| Second Dealer Reel | one White 7 |
| Player Reel | one White 7 and one Blue 7 |

The exemplary game is played by players who are seated upon five evenly spaced seats 26–30 disposed adjacent to the edge 12. The seats 26–30 are next to five player stations 31–35, respectively, that are carried upon the covering 11 adjacent to the edge 12. Since there are five player stations 31–35, the game can be played by at least one player and no more than five players. In an alternative embodiment, more than five players can play the game.

The stations 31–35 include similar identifiable polygonal bet areas 31A–35A, respectively. The bet areas may be any suitable shape or design and may carry therein the word, BET, for identification.

The stations 31–35 additionally include similar identifiable polygonal ante areas 31D–35D, respectively. The ante areas 31D–35D may be of any suitable shape or design and may carry therein the word, ANTE, for identification.

The payline is flanked by similar display monitors 36, 38. Because the monitors 36, 38 flank the payline, at least one of the monitors 36, 38 can be viewed by the players.

The monitors 36, 38 are comprised of a multiplicity of light emitting diodes (LED's). At the start of a round of play, the word, ANTE, is displayed by the monitors 36, 38 by a selective illumination of the LED's. In response to the display of the word, ANTE, players at the seats 26–30, wishing to play the game, place wagering tokens representative of a predetermined ante wager within the ante areas 31D–35D, respectively. Monitors that include LED's are well known to those skilled in the art.

A control panel 40 of the machine 20 is mounted above the payline. The control panel 40 includes a spin button 42. In response to a depression of the spin button 42, the dealer reels briefly spin. The dealer 16 depresses the spin button 42 after the players place the ante wager. In response to the spinning of the dealer reels, there is a selective illumination of the LED's, whereby the word, BET, is displayed by the monitors 36, 38.

When the word, BET, is displayed, the players at the stations 31–35 have an option of placing wagering tokens representative of a combination bet within the bet areas 31A–35A, respectively. The combination bet has an upper limit of five times the ante wager. When, for example, the ante wager is five dollars, the combination bet may be as much as twenty five dollars. In an alternative embodiment, the upper limit is different from five times the ante wager. As explained hereinafter the ante wager and the combination bet are either won or lost in accordance with a combination of the sevens that appear on the payline after a spinning of the player reel.

The player stations 31–35 additionally include spin buttons 31F–35F, respectively. Correspondingly, the panel 40 includes spin enable buttons 51–56. The spin buttons 31F–35F and the enable buttons 51–56 are of a type that include an incandescent bulb therein that is operable to illuminate a viewable surface thereof.

When the word, BET, is displayed, the viewable surface of the enable button 51 may be illuminated for reasons described hereinafter. In response to the enable button 51 being depressed by the dealer 16, the viewable surface of the spin button 31F is illuminated. Depression of the spin button 31F by a player at the seat 26 causes the player reel to briefly spin. Additionally, the illumination of the viewable surfaces of the spin button 31F and the enable button 51 are extinguished.

After the spinning of the player reel, the word, ANTE, is displayed by the monitors 36, 38 and all wagers are reconciled. More specifically, in the absence of a winning combination on the payline, the wagers are reconciled by the dealer 16 taking the wagering tokens within the ante areas 31D–35D and the bet areas 31A–35A. When there is a winning combination, all bets and wagers are reconciled by the dealer 16 making a payout to the players. The winning combinations and the payouts are in accordance with table III which is given as:

TABLE III

| WINNING COMBINATION | PAYOUT ON COMBINATION BET AND ANTE |
|---|---|
| Three Blue 7's | 1 to 1 |
| Three White 7's | 2 to 1 |
| Three Red 7's | 5 to 1 |
| a Red, a White and a Blue 7 | 1 to 1 |
| Three Gold Outlined 7's | 1 to 1 |

A showing of a payout multiplier number is provided by a single character seven segment display 58 on the panel 40. When, for example, the payline is comprised of the Red 7's, the display 58 provides a showing of the number five. In response to the showing of the number five, the dealer 16 makes the 5 to 1 payout to the players. In other words, the display 58 is for the convenience of the dealer 16. Seven segment displays are well known to those skilled in the art. Preferably, the payout multiplier number is displayed by the monitors 36, 38 to inform the players of their payout.

Usually, it is desirable to have the players at the seats 26–30 take turns at causing the player reel to spin during successive rounds of play. Thus, when depressing the spin button 31F causes the spinning of the player reel, the viewable surface of the enable button 52 is illuminated after a spinning of the dealer reels during the next succeeding round of play. The illumination of the viewable surface of the enable button 52 signals the dealer 16 that after the wagering tokens are placed within the bet areas 31A–35A, the enable button 52 should be depressed.

In response to the enable button 52 being depressed by the dealer 16, the viewable surface of the spin button 32F is illuminated. Depression of the spin button 32F by the player at the seat 27 causes the player reel to briefly spin. Additionally, the illumination of the viewable surfaces of the spin button 32F and the enable button 52 are extinguished, as described hereinbefore in connection with the spin button 31F and the enable button 51.

It should be understood that after a round of play that causes the illumination of the viewable surface of the enable button 55 to be extinguished, the spinning of the dealer reels causes an illumination of the spin enable button 51. All of the spin buttons 31F–35F and the enable buttons 51–55 operate in a similar manner.

When, for example, the player at the seat 27 does not choose to depress the spin button 32F, the dealer 16 typically depresses the enable button 53. Thereafter, the spin button 33F is depressed by the player at the seat 28 to cause the spinning of the player reel.

When all of the players decline to depress one of the spin buttons 31F–35F, the dealer 16 causes the spinning of the player reel by depressing the spin enable button 56 and a default spin button 57 on the panel 40. When depressing the spin button 57 causes the spinning of the player reel, the viewable surface of the enable button associated with the station of the player who first declined is illuminated after a spinning of the dealer reels during the next succeeding round of play.

In a second embodiment of the present invention, the stations 31–35 additionally include similar circular wagering locations 31G–35G, respectively. The locations 31G–35G may alternatively have any suitable shape other than circular. Next to each of the locations 31G–35G is the lettering of "200:1 3 RED 7 's".

Prior to the spinning of the dealer reels, the players at the stations 31–35 have an option of making what is known as a proposition bet by placing wagering tokens within the locations 31G–35G, respectively. The players win the proposition bet when the spinning of the dealer's and player's reels results in the proposition, i.e. three Red 7's to appear on the payline.

When the three Red 7's appear, the proposition bet is reconciled by the dealer making a payout of 200 to 1 to the players who make the proposition bet. When the spinning of the dealer's and player's reels does not cause the three Red 7's to appear on the payline, the proposition bet is reconciled by the dealer taking the wagering tokens within the locations 31G–35G. It should be understood that the probability of the appearance of the three red sevens is 1 in 216.

In one alternative embodiment, the players have an opportunity to make other proposition bets than the one described hereinbefore. In another alternative embodiment, all wagering is comprised of proposition bets.

There is an illumination of a viewable surface of one of the spin buttons 31F–35F in response to one of the enable buttons 51–55 being depressed as described hereinbefore. All of the reels briefly spin in response to the illuminated spin button being depressed.

It should be appreciated that the exemplary game should appeal to both slot machine and table game players. Further it enables companions to play the same machine, winning and losing together. Still further, by providing the separate dealer reel and player reel initiation, the players each have the opportunity to participate in the game and receive credit from the other players when a winning combination results. Additionally, the game is fast moving and exciting.

From the standpoint of the casino, the game entices slot machine players to play a table game and table players to play a slot game. Further, since a single device can accommodate multiple players, the amounts wagered known as "the drop" are greater than would be observed by just a slot machine.

While the invention has been particularly shown and described with reference to embodiments thereof, it should be understood by those skilled in the art that changes in form and detail may be made therein without departing from the spirit and scope of the invention. In particular, the slot machine may be either an electro-mechanical or a video type and there may be any number of reels, and indicia thereon may vary from game to game.

I claim:

1. A method of playing a game at a table, comprising the steps of:

causing an indicium on one of a plurality of arc segments of a player reel of a slot machine to randomly appear on a payline of the machine in response to operation of a spin button at a player station carried on a covering of the top of said table;

giving a player an option of placing a bet on a prospective appearance of said indicium on said payline; and operating said player spin button.

2. In the method of claim 1 wherein said player reel indicium randomly appears in response to operation of said spin button after operation of a spin enable button.

3. In the method of claim 2, the additional step of causing an indicium on one of a plurality of arc segments of a dealer reel to randomly appear on said payline in response to operation of a dealer spin button.

4. In the method of claim 3, the additional steps of:

said player placing an ante wager at the start of a round of play; and reconciling said ante wager and said bet after said indicia on said player and dealer reels appear on said payline.

5. In the method of claim 4 wherein the step of said player placing said ante wager includes the step of placing wagering tokens representative of said ante wager within an ante area of said player station.

6. In the method of claim 5 wherein the step of said player placing said bet includes the step of placing wagering tokens representative of said bet within a bet area of said player station.

7. In the method of claim 5 wherein said bet and ante areas are identified by lettering of the words, BET and ANTE, respectively, carried therein.

8. In the method of claim 1, the additional step of providing a default spin button that is operable to cause said indicium on one of said plurality of arc segments of said player reel to randomly appear on said payline.

9. A game played by a player and a dealer at a table, comprising:

a slot machine that provides to said player a view of a payline having one of a plurality of indicium on respective arc segments of a dealer reel and one of a plurality of indicium on respective arc segments of a player reel;

means for causing a random appearance on said payline of an indicium on an arc segment of said dealer reel; and means for causing a random appearance on said payline of an indicium on an arc segment of said player reel.

10. The game of claim 9, wherein said means for causing said appearance of said indicium on said dealer reel is comprised of a dealer spin button on a control panel of said machine, said dealer spin button being operable to cause a spinning of said dealer reel.

11. The game of claim 9, said means for causing said appearance of said indicium on said player reel comprising:

a player spin button of a player station that is carried on a covering of the top of said table; and a dealer enable button on a control panel of said machine, said dealer enable button and said player spin button being operated to cause a spinning of said player reel.

12. The game of claim 11 wherein a viewable surface of said player spin button is illuminated in response to said dealer enable button being operated.

13. The game of claim 9, said means for causing said appearance of said indicium on said player reel comprising a default spin button on a control panel of said machine.

14. The game of claim 9 additionally comprising a player station carried on a covering of the top of said table, said player station having a wagering area adapted to receive wagering tokens thereon.

* * * * *